US009562653B2

(12) United States Patent
Kang

(10) Patent No.: US 9,562,653 B2
(45) Date of Patent: Feb. 7, 2017

(54) LIGHTING DEVICE

(75) Inventor: Sung Ku Kang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/343,600

(22) PCT Filed: Sep. 7, 2012

(86) PCT No.: PCT/KR2012/007210
§ 371 (c)(1),
(2), (4) Date: Mar. 7, 2014

(87) PCT Pub. No.: WO2013/036061
PCT Pub. Date: Mar. 14, 2013

(65) Prior Publication Data

US 2014/0210333 A1 Jul. 31, 2014

(30) Foreign Application Priority Data

Sep. 8, 2011 (KR) ..... 10-2011-0091108

(51) Int. Cl.

| | |
|---|---|
| ***F21V 7/09*** | (2006.01) |
| ***F21K 99/00*** | (2016.01) |
| ***F21V 7/00*** | (2006.01) |
| ***F21V 11/14*** | (2006.01) |
| ***F21V 3/02*** | (2006.01) |
| ***F21V 29/74*** | (2015.01) |

(Continued)

(52) U.S. Cl.
CPC ..... *F21K 9/1355* (2013.01); *F21K 9/23* (2016.08); *F21K 9/60* (2016.08); *F21V 3/02* (2013.01); *F21V 7/0016* (2013.01); *F21V 11/14* (2013.01); *F21V 29/74* (2015.01); *F21V 7/05* (2013.01); *F21V 13/02* (2013.01); *F21V 29/773* (2015.01); *F21Y 2101/00* (2013.01); *F21Y 2105/10* (2016.08); *F21Y 2115/10* (2016.08)

(58) Field of Classification Search
CPC ..... F21V 11/14; F21V 29/70; F21V 29/02; F21V 29/2206; F21V 3/02
USPC ..... 313/46
See application file for complete search history.

(56) References Cited

U.S. PATENT DOCUMENTS 6,464,373 B1 * 10/2002 Petrick ..... 362/235
6,758,582 B1 7/2004 Hsiao et al.
(Continued)

FOREIGN PATENT DOCUMENTS

CN 101275731 A 10/2008
CN 100595479 C 3/2010
(Continued)

OTHER PUBLICATIONS

International Search Report issued in PCT/KR2012/007210 dated Jan. 22, 2013.
(Continued)

*Primary Examiner* — Nimeshkumar Patel
*Assistant Examiner* — Christopher Raabe
(74) *Attorney, Agent, or Firm* — KED & Associates, LLP

(57) ABSTRACT

A lighting device may be provided that comprises: a heat sink; a light source which is disposed on the heat sink; a cover which is coupled to the heat sink and includes a dome disposed on the light source and a body supporting the dome; and a reflective plate which is disposed in the body and has an opening through which a part of light from the light source passes.

18 Claims, 7 Drawing Sheets

(51) Int. Cl.

| | |
|---|---|
| *F21V 7/05* | (2006.01) |
| *F21V 13/02* | (2006.01) |
| *F21V 29/77* | (2015.01) |
| *F21Y 101/00* | (2016.01) |

(56) References Cited

U.S. PATENT DOCUMENTS

| | | | | |
|---|---|---|---|---|
| 8,324,790 | B1 * | 12/2012 | Hu | 313/113 |
| 2003/0193807 | A1 | 10/2003 | Rizkin et al. | |
| 2005/0243552 | A1 | 11/2005 | Maxik | |
| 2005/0270780 | A1 * | 12/2005 | Zhang | 362/257 |
| 2006/0227566 | A1 * | 10/2006 | Lee | 362/509 |
| 2011/0068687 | A1 * | 3/2011 | Takahasi et al. | 315/35 |
| 2011/0140149 | A1 | 6/2011 | Liu et al. | |
| 2011/0175528 | A1 * | 7/2011 | Rains et al. | 315/51 |
| 2011/0215700 | A1 * | 9/2011 | Tong et al. | 313/46 |
| 2011/0254421 | A1 * | 10/2011 | Thomas | 313/46 |
| 2012/0025705 | A1 * | 2/2012 | Chang | 315/32 |
| 2012/0139403 | A1 * | 6/2012 | Johnston et al. | 313/46 |
| 2012/0273812 | A1 * | 11/2012 | Takahashi et al. | 257/88 |
| 2013/0128570 | A1 * | 5/2013 | Jiang et al. | 362/235 |
| 2014/0043820 | A1 * | 2/2014 | Ye et al. | 362/291 |

FOREIGN PATENT DOCUMENTS

| | | | |
|---|---|---|---|
| JP | 2010-282838 | A | 12/2010 |
| JP | 2011-159637 | A | 8/2011 |
| KR | 10-2010-0096979 | A | 9/2010 |
| KR | 10-1007913 | B1 | 1/2011 |
| WO | WO 2010/146518 | A1 | 12/2010 |

OTHER PUBLICATIONS

Chinese Office Action for Application 201280043851.3 dated Jan. 5, 2016 (full Chinese text).

Chinese Office Action for Application 201280043851.3 dated Jan. 5, 2016 (full English translation).

European Search Report dated Jan. 12, 2015 issued in Application No. 12829749.6.

* cited by examiner

LIGHTING DEVICE

CROSS-REFERENCE TO RELATED PATENT APPLICTIONS

The present application is a U.S national stage application under 35 U.S.C. 371 of PCT Application No. PCT/KR2012/007210, filed Sep. 7, 2012, which claims priority to Korean Patent Application No. 10-2011-0091108, filed Sep. 8, 2011, the entireties of which are incorporated herein by reference.

TECHNICAL FIELD

This embodiment relates to a lighting device.

BACKGROUND ART

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

DISCLOSURE OF INVENTION

Technical Problem

The objective of the present invention is to provide a lighting device has rear light distribution characteristic.

The objective of the present invention is to provide a lighting device capable of removing a dark portion.

The objective of the present invention is to provide a lighting device satisfying Energy Star specifications.

Solution to Problem

One embodiment is a lighting device. The lighting device comprises: a heat sink; a light source which is disposed on the heat sink; a cover which is coupled to the heat sink and comprises a dome disposed on the light source and a body supporting the dome; and a reflective plate which is disposed in the body and has an opening through which a part of light from the light source passes.

The body has an upper opening and a lower opening. The reflective plate is disposed in the upper opening.

The body comprises an upper portion and a lower portion. The dome is coupled to the upper portion.

The body of the cover has a cylindrical shape.

The body of the cover comprises a second body which is coupled to the heat sink, and a first body which is disposed on the second body and on which the reflective plate is disposed. The second body has an upper opening and a lower opening. The diameter of the lower opening of the second body is less than that of the upper opening of the second body.

The first body has an upper opening and a lower opening. The diameter difference between the upper opening of the first body and the lower opening of the first body is within 5%.

The reflective plate is disposed in the upper opening of the first body.

The first body has a cylindrical shape of which the diameter is constant toward a lower portion of the first body from an upper portion of the first body. The second body has a cylindrical shape of which the diameter decreases toward a lower portion of the second body from an upper portion of the second body.

A maximum diameter of the first body is larger than that of the heat sink.

An opening of the reflective plate is formed at the center thereof. The reflective plate further has a plurality of holes formed around the opening.

The hole is smaller than the opening.

The heat sink comprises: a placement portion on which the light source is disposed; a guide which is coupled to the body of the cover; and a recess which is formed between the placement portion and the guide and on which the body of the cover is disposed.

The light source comprises a substrate disposed on the placement portion of the heat sink, and a light emitting device disposed on the substrate. The placement portion of the heat sink comprises a guider which guides the substrate.

The heat sink comprises a receiver. The lighting device further comprises: a circuitry which is disposed in the receiver of the heat sink and is electrically connected to the light source; and an inner case in which the circuitry is disposed and which is disposed in the receiver of the heat sink.

The lighting device further comprises a holder which is coupled to the inner case and wherein the holder and the inner case cover the circuitry.

Another embodiment is a lighting device. The lighting device comprises: a heat sink including one side; a light source including a substrate disposed on the one side of the heat sink, a light emitting device disposed on the substrate; a cover which is disposed on the light source and is coupled to the heat sink; and a reflective plate which is disposed within the cover, reflects light from the light source and has a hole transmitting a part of the light from the light source.

The hole of the reflective plate comprises a first hole formed at the center of the reflective plate, and second holes formed around the first hole. The diameter of the first hole is larger than that of the second hole.

The cover comprises: a hemispherical upper portion; and a lower portion which is disposed under the upper portion and surrounds the light source. The reflective plate is disposed within the lower portion.

The lower portion comprises: a first lower portion coupled to the upper portion; and a second lower portion which is disposed under the first lower portion and is coupled to the heat sink. A minimum diameter of the second lower portion is less than that of the first lower portion.

The one side of the heat sink has a circular shape. The diameter of the circular side is less than the minimum diameter of the first lower portion.

Advantageous Effects of Invention

A lighting device in accordance with the present invention has rear light distribution characteristic.

A lighting device in accordance with the present invention is capable of removing a dark portion.

A lighting device in accordance with the present invention is capable of satisfying Energy Star specifications.

MODE FOR THE INVENTION

A thickness or size of each layer is magnified, omitted or schematically shown for the purpose of convenience and clearness of description. The size of each component does not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed between the two elements. The "on" and "under" will be described to include the upward and downward directions based on one element.

Hereafter, a lighting device according to an embodiment will be described with reference to the accompanying drawings.

Figure 1:
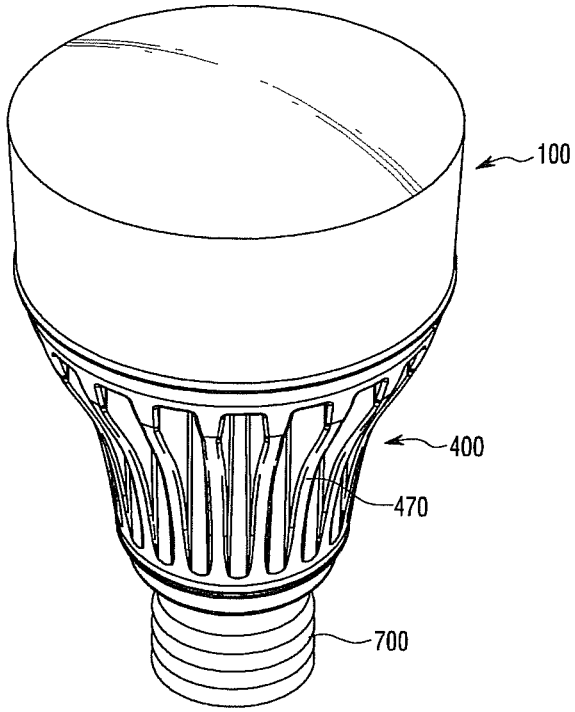
FIG. 1 is a perspective view of a lighting device according to an embodiment.
Figure 2:
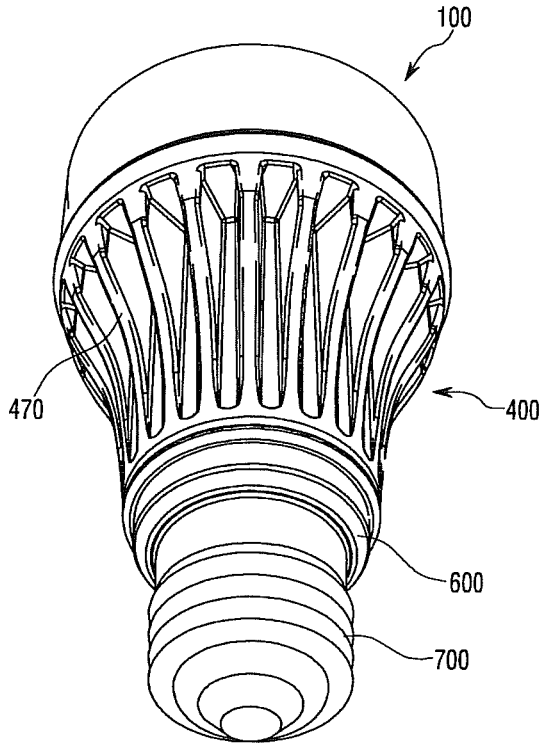
FIG. 2 is a bottom perspective view of the lighting device shown in FIG. 1.
Figure 3:
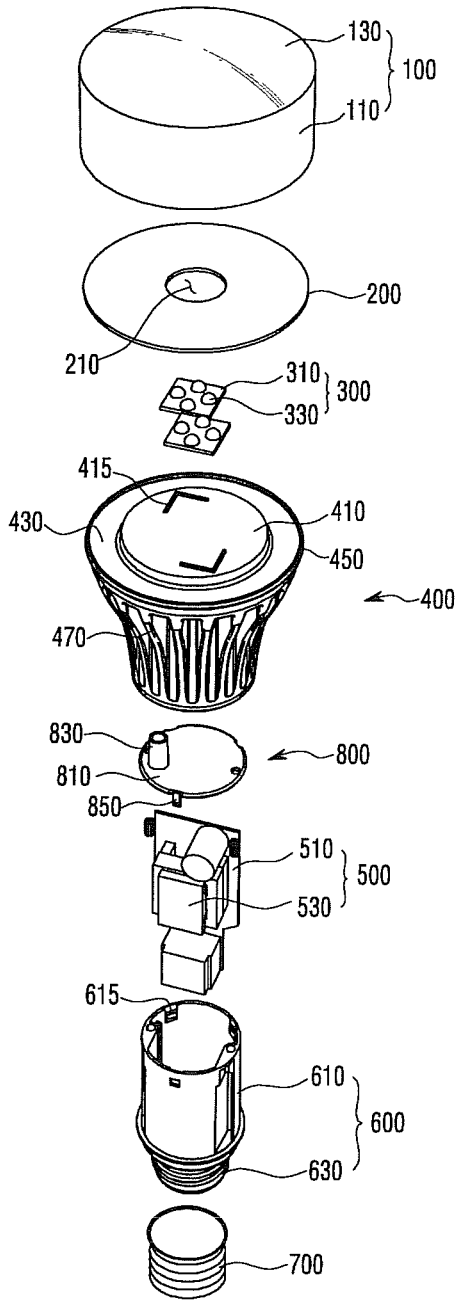
FIG. 3 is an exploded perspective view of the lighting device shown in FIG. 1.
Figure 4:
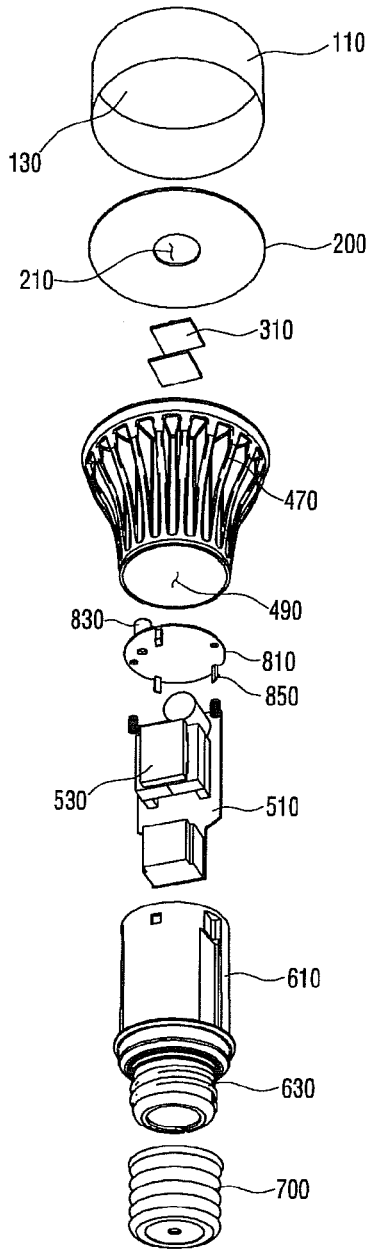
FIG. 4 is an exploded perspective view of the lighting device shown in FIG. 2.

FIG. 1 is a perspective view of a lighting device according to an embodiment. FIG. 2 is a bottom perspective view of the lighting device shown in FIG. 1. FIG. 3 is an exploded perspective view of the lighting device shown in FIG. 1. FIG. 4 is an exploded perspective view of the lighting device shown in FIG. 2.

Referring to FIGS. 1 to 4, the lighting device according to the embodiment may include a cover 100, a reflective plate 200, a light source 300, a heat sink 400, a circuitry 500, an inner case 600 and a socket 700. Hereafter, respective components will be described in detail.

The cover 100 may be disposed on the light source 300 and may receive the reflective plate 200 therewithin.

The cover 100 may include a body 110 and a dome 130. Here, the body 110 may be the lower portion of the cover 100 and the dome 130 may be the upper portion of the cover 100.

The body 110 may have a cylindrical shape. Here, the cylindrical shape includes not only a geometrically perfect cylinder but also a cylinder of which the upper opening is larger or smaller than the lower opening. Hereafter, the body 110 is described by being assumed to be a cylindrical portion.

The cylindrical portion 110 is disposed on the heat sink 400 and surrounds the light source 300. The cylindrical portion 110 may be coupled to the heat sink 400.

The cylindrical portion 110 has an upper opening and a lower opening. The upper opening may be defined by the upper portion of the cylindrical portion 110. The lower opening may be defined by the lower portion of the cylindrical portion 110.

The dome 130 is disposed on the upper opening of the cylindrical portion 110. In other words, the upper portion of the cylindrical portion 110 is coupled to the dome 130.

The heat sink 400 is disposed on the lower opening of the cylindrical portion 110. In other words, the lower portion of the cylindrical portion 110 is coupled to the heat sink 400.

The dome 130 is coupled to the cylindrical portion 110. Specifically, the dome 130 is connected to the upper portion of the cylindrical portion 110 in such a manner as to block the upper opening of the cylindrical portion 110.

The dome 130 may have a hemispherical shape. Here, the hemispherical shape includes not only a geometrically perfect hemisphere but also a hemisphere of which the curvature is larger or smaller than that of the perfect hemisphere.

The cover 100 is coupled to the heat sink 400. The reflective plate 200 and the light source 300 are sealed from the outside by the coupling of the cover 100 and the heat sink 400.

The cover 100 and the heat sink 400 may be coupled to each other by connecting the lower portion of the cylindrical portion 110 of the cover 100 to a guide 450 of the heat sink 400. Otherwise, the cover 100 and the heat sink 400 may be coupled to each other by using an adhesive or various methods, for example, rotary coupling, hook coupling and the like. In the rotary coupling method, the screw thread of the cover 100 is coupled to the screw groove of the heat sink 400. That is, the cover 100 and the heat sink 400 are coupled to each other by the rotation of the cover 100. In the hook coupling method, the cover 100 and the heat sink 400 are coupled to each other by inserting and fixing a protrusion of the cover 100 into the groove of the heat sink 400.

The cover 100 is optically coupled to the light source 300. Specifically, the cover 100 may diffuse, scatter or excite light emitted from a light emitting device 330 of the light source 300. Here, the inner/outer surface or the inside of the cover 100 may include a fluorescent material so as to excite the light emitted from the light emitting device 330.

The inner surface of the cover 100 may be coated with an opalescent pigment. Here, the opalescent pigment may include a diffusing agent diffusing the light.

The roughness of the inner surface of the cover 100 may be larger than that of the outer surface of the cover 100. This intends to sufficiently scatter and diffuse the light emitted from the light source 300.

The cover 100 may be formed of glass, plastic, polypropylene (PP), polyethylene (PE), polycarbonate (PC) and the like. Here, the polycarbonate (PC) has excellent light resistance, thermal resistance and rigidity.

The cover 100 may be formed of a transparent material causing the light source 300 and the reflective plate 200 to be visible to the outside or may be formed of an opaque material causing the light source 300 and the reflective plate 200 not to be visible to the outside.

The cover 100 may be formed by separately injection-molding and coupling the cylindrical portion 110 and the dome 130 or by integrally forming the cylindrical portion 110 and the dome 130.

The reflective plate 200 reflects light emitted from the light source 300. For this purpose, the reflective plate 200 has a predetermined reflectance. Here, the reflectance of the reflective plate 200 may be from 90% to 99%. The reflective plate 200 may be an aluminum plate or a common plate of which the surface is deposited with Ag.

The reflective plate 200 may have a circular plate shape or a polygonal plate shape. A predetermined opening 210 is formed at the center of the plate. A part of the light emitted from the light source 300 is able to travel directly to the dome 130 through the opening 210.

The reflective plate 200 is disposed in the cover 100. The reflective plate 200 may be disposed to be received within the cylindrical portion 110 of the cover. The reflective plate 200 may be disposed in the upper portion or middle portion of the cylindrical portion 110.

The maximum diameter of the reflective plate 200 may correspond to the diameter of the cylindrical portion 110. Particularly, in order that the reflective plate 200 is fixed to the upper portion of the cylindrical portion 110, the reflective plate 200 may have a size corresponding to the size of the upper opening of the cylindrical portion 110.

The reflective plate 200 reflects a part of the light emitted from the light emitting device 330 of the light source 300 and transmits the other part of the light. The light is transmitted through the opening 210 of the reflective plate 200. In particular, the reflective plate 200 reflects light incident from the light emitting device 330 to the inner surface of the cylindrical portion 110. Accordingly, the light incident on the cylindrical portion 110 passes through the cylindrical portion 110 and realizes the rear light distribution of the lighting device according to the embodiment.

The light source 300 is disposed on the heat sink 400. Specifically, the light source 300 may be disposed on a placement portion 410 of the heat sink 400.

A plurality of the light sources 300 may be disposed. Though FIGS. 3 and 4 show that the two light sources 300 are disposed on the placement portion 410 of the heat sink 400, there is no limit to this. Three or more light sources 300 may be disposed on the heat sink 400. The number of the light sources 300 may be changed according to the power (W) of the lighting device according to the embodiment.

The light source 300 may include a substrate 310 and the light emitting device 330.

The substrate 310 is disposed on the placement portion 410 of the heat sink 400. The substrate 310 may be guided by a guider 415 of the placement portion 410.

The substrate 310 may have a quadrangular plate shape. However, the substrate 310 may have various shapes without being limited to this. For example, the substrate 310 may have a circular plate shape or a polygonal plate shape. The substrate 310 may be formed by printing a circuit pattern on an insulator. For example, the substrate 310 may include a common printed circuit board (PCB), a metal core PCB, a flexible PCB, a ceramic PCB and the like. Also, the substrate 310 may include a chips on board (COB) allowing an unpackaged LED chip to be directly bonded to a printed circuit board. The substrate 310 may be formed of a material capable of efficiently reflecting light. The surface of the substrate 310 may have a color such as white, silver and the like capable of efficiently reflecting light.

The surface of the substrate 310 may be coated with a material capable of efficiently reflecting light or may be coated with a color, for example, white, silver and the like.

The substrate 310 is electrically connected to the circuitry 500 received in the heat sink 400. The substrate 310 may be connected to the circuitry 500 by means of a wire. The wire passes through the heat sink 400, and then is able to electrically connect the substrate 310 with the circuit board 510.

A plurality of the light emitting devices 330 are disposed on one side of the substrate 310. The reflective plate 200 and the cover 100 are disposed on the light emitting device 330.

The light emitting device 330 may be a light emitting diode chip emitting red, green and blue light or a light emitting diode chip emitting UV. Here, the light emitting diode chip may have a lateral type or vertical type and may emit blue, red, yellow or green light.

The light emitting device 330 may have a fluorescent material. The fluorescent material may include at least any one selected from a group consisting of a garnet material (YAG, TAG), a silicate material, a nitride material and an oxynitride material. Otherwise, the fluorescent material may include at least any one selected from a group consisting of a yellow fluorescent material, a green fluorescent material and a red fluorescent material.

The heat sink 400 is coupled to the cover 100 and radiates heat from the light source 300.

The heat sink 400 includes the placement portion 410. At least one light source 300 is disposed on one side of the placement portion 410.

The placement portion 410 may include the guider which fixes the substrate 310 of the light source 300 to the placement portion 410 and determines the position of the substrate 310 in advance. The guider 415 may have an 'L'-shape projecting upward from the placement portion 410 in such a manner as to contact with at least two sides of the substrate 310. However, there is no limit to this. The guider 415 may have various shapes in accordance with the shape of the substrate.

The placement portion 410 may project upward from a base 430.

The heat sink 400 may include the base 430. The base 430 has a predetermined level difference with respect to the placement portion 410. That is, the base 430 is disposed under the placement portion 410. The base 430 is disposed between the placement portion 410 and the guide 450. The base 430 is disposed under the placement portion 410 and the guide 450. Accordingly, a predetermined recess may be formed between the placement portion 410 and the guide 450. The lower portion of the cylindrical portion 110 of the cover 100 is inserted into the recess. The diameter of the base 430 may correspond to that of the lower opening of the cylindrical portion 110 of the cover 100.

The heat sink 400 may include the guide 450. The guide 450 may be coupled to the lower portion of the cylindrical portion 110 of the cover 100.

The heat sink 400 includes a heat radiating fin 470. A plurality of the heat radiating fins 470 may be disposed on the side of the heat sink 400.

The heat radiating fin 470 may be formed by extending outwardly the side of the heat sink 400 or may be formed by two recesses formed toward the inside of the heat sink 400 from the side of the heat sink 400.

The heat radiating fin 470 is able to improve heat radiation efficiency by increasing the radiating heat area of the heat sink 400.

The heat sink 400 has a receiver 490. The receiver 490 receives the circuitry 500 and the inner case 600. The receiver 490 may be a cavity formed toward the inside of the heat sink 400 from one side of the heat sink 400. The receiver 490 may have a cavity having a shape corresponding to the shape of a receiver 610 of the inner case 600.

The heat sink 400 may be formed of Al, Ni, Cu, Mg, Ag, Sn and the like and an alloy including the metallic materials. The heat sink 400 may be also formed of thermally conductive plastic. The thermally conductive plastic is lighter than a metallic material and has a unidirectional thermal conductivity.

The circuitry 500 receives external electric power, and then converts the received electric power in accordance with the light source 300. The circuitry 500 supplies the converted electric power to the light source 300.

The circuitry 500 is received in the heat sink 400. Specifically, the circuitry 500 is received in the inner case 600, and then, together with the inner case 600, is received in the receiver 490 of the heat sink 400.

The circuitry 500 may include the circuit board 510 and a plurality of parts 530 mounted on the circuit board 510.

The circuit board 510 may have a quadrangular plate shape. However, the circuit board 510 may have various shapes without being limited to this. For example, the circuit board 510 may have an elliptical plate shape or a polygonal plate shape. The circuit board 510 may be formed by printing a circuit pattern on an insulator.

The circuit board 510 is electrically connected to the substrate 310 of the light source 300. The circuit board 510 may be electrically connected to the substrate 310 by using a wire. That is, the wire is disposed within the heat sink 400 and may connect the circuit board 510 with the substrate 310.

The plurality of the parts 530 may include, for example, a DC converter converting AC power supply supplied by an external power supply into DC power supply, a driving chip controlling the driving of the light source 300, and an electrostatic discharge (ESD) protective device for protecting the light source 300.

The inner case 600 receives the circuitry 500 thereinside. The inner case 600 may have the receiver 610 for receiving the circuitry 500. The receiver 610 may have a cylindrical shape. The shape of the receiver 610 may correspond to the shape of the receiver 490 of the heat sink 400.

The inner case 600 is received in the heat sink 400. The receiver 610 of the inner case 600 is received in the receiver 490 of the heat sink 400.

The inner case 600 is coupled to the socket 700. The inner case 600 may include a connection portion 630 which is coupled to the socket 700. The connection portion 630 may have a screw thread corresponding to a screw groove of the socket 700.

The inner case 600 is a nonconductor. Therefore, the inner case 600 prevents electrical short-cut between the circuitry 500 and the heat sink 400. The inner case 600 may be made of a plastic or resin material.

Here, in order to insulate the circuitry 500 from the heat sink 400, the lighting device according to the embodiment may further include a holder 800 which is coupled to the inner case 600.

The holder 800 includes a sealing plate 810 which seals the receiver 610 of the inner case 600.

The holder 800 includes a cap 830 surrounding the wire which electrically connects the circuit board 510 with the substrate 310. The cap 830 may be disposed on the sealing plate 810.

The holder 800 may include a catching projection 850 allowing the holder 800 to be coupled to the receiver 610 of the inner case 600. The catching projection 850 is coupled to a catching recess 615 disposed in the receiver 610 of the inner case 600. The holder 800 can be securely coupled to the inner case 600 by the catching projection 850 and the catching recess 615.

The socket 700 is coupled to the inner case 600. Specifically, the socket 700 is coupled to the connection portion 630 of the inner case 600.

The socket 700 may have the same structure as that of a conventional incandescent bulb. The circuitry 500 is electrically connected to the socket 700. The circuitry 500 may be electrically connected to the socket 700 by using a wire. Therefore, when external electric power is applied to the socket 700, the external electric power may be transmitted to the circuitry 500.

The socket 700 may have a screw groove corresponding to the screw thread of the connection portion 630.

Figure 5:
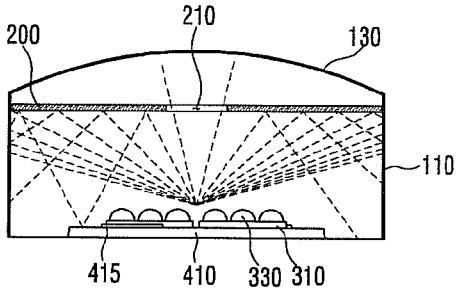
FIG. 5 is a view for describing the movement of light within a cover of the lighting device according to the embodiment shown in FIGS. 1 to 4.

FIG. 5 is a view for describing the movement of light within the cover 100 of the lighting device according to the embodiment shown in FIGS. 1 to 4.

Referring to FIG. 5, FIG. 5 shows that a part of the light emitted from the light emitting device 330 of the light source 300 passes through the opening 210 of the reflective plate 200 and reaches the dome 130, the other part of the light is reflected by the reflective plate 200 and is incident on the cylindrical portion 110 of the cover. Here, the light incident on the cylindrical portion 110 is inclined from the upper portion to the lower portion of the cylindrical portion 110. Therefore, the lighting device according to the embodiment is able to provide the rear light distribution.

Figure 6:
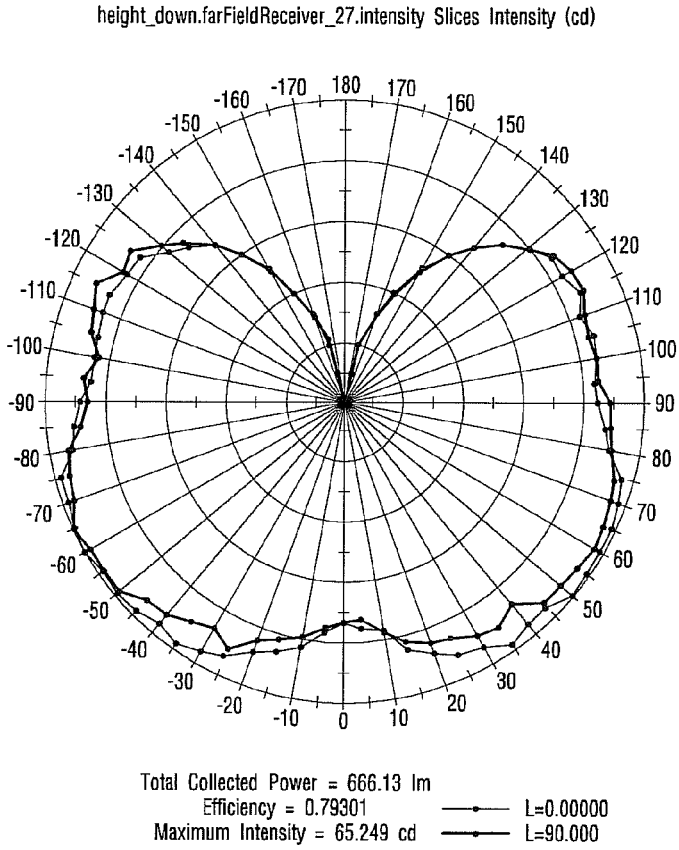
FIG. 6 is a diagram showing luminous intensity distribution of the lighting device shown in FIGS. 1 to 4.

FIG. 6 is a diagram showing luminous intensity distribution of the lighting device shown in FIGS. 1 to 4.

Referring to FIG. 6, it can be seen that luminous flux (lumen) between 130° to 180° is larger than 10% of the total luminous flux. Therefore, it can be seen that the lighting device according to the embodiment satisfies Energy Star specifications.

Figure 7:
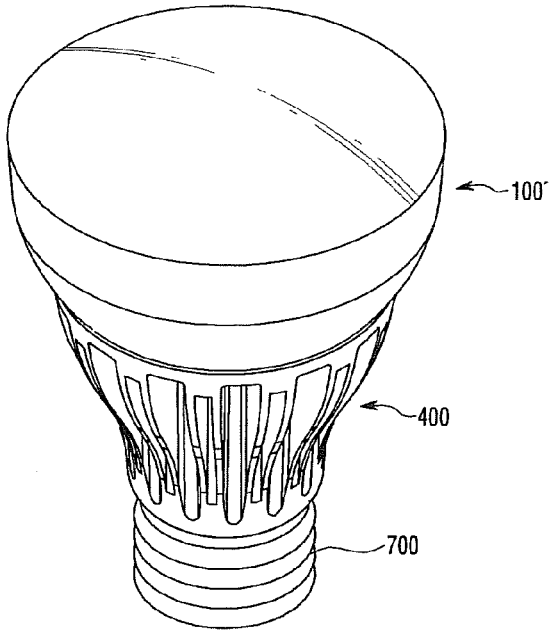
FIG. 7 is a perspective view of a lighting device according to another embodiment.
Figure 8:
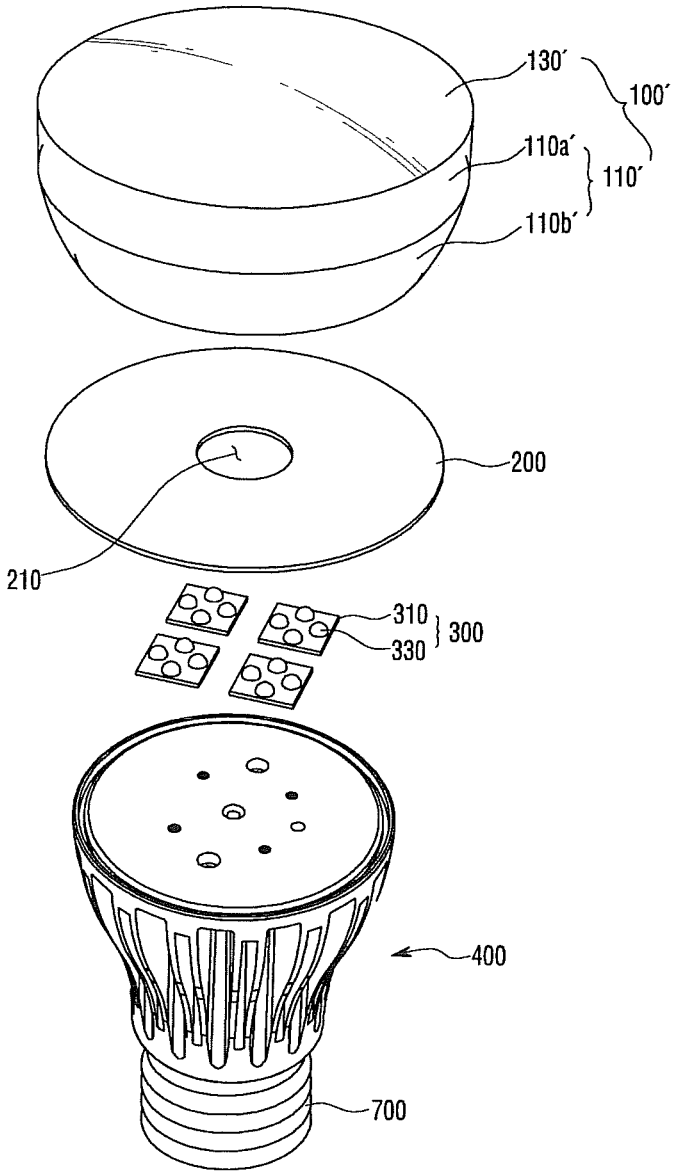
FIG. 8 is an exploded perspective view of the lighting device shown in FIG. 7.

FIGS. 7 to 8 are views for describing a lighting device according to another embodiment.

FIG. 7 is a perspective view of a lighting device according to another embodiment. FIG. 8 is an exploded perspective view of the lighting device shown in FIG. 7.

The lighting device shown in FIGS. 7 to 8 may include the circuitry 500, the inner case 600, the socket 700 and the holder 800 of the lighting device shown in FIGS. 1 to 4. Since these components have been already described above, the detailed description thereof will be omitted.

In the components of the lighting device shown in FIGS. 7 to 8, the same reference numerals will be assigned to the same components as those of the lighting device shown in FIGS. 1 to 4. Detailed descriptions thereof will be replaced by the foregoing descriptions.

In the lighting device shown in FIGS. 7 to 8, a cover 100' is different from the cover 100 shown in FIGS. 1 to 4. Hereafter, this will be described in detail with reference to FIG. 9.

Figure 9:
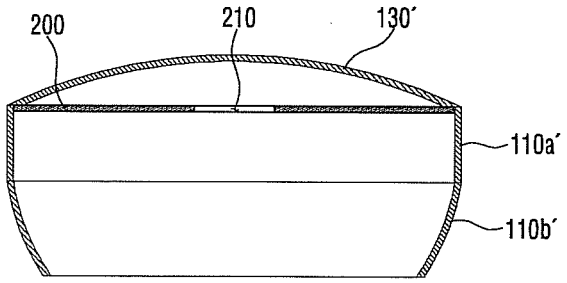
FIG. 9 is a cross sectional view showing a cover and a reflective plate of the lighting device shown in FIG. 7.

FIG. 9 is a cross sectional view showing the cover 100' and the reflective plate 200 of the lighting device shown in FIG. 7.

Referring to FIGS. 7 to 9, the cover 100' includes a body 110' and a dome 130'. Here, the body 110' may be the lower portion of the cover 100' and the dome 130' may be the upper portion of the cover 100'.

The body 110' may be a cylindrical portion. Hereafter, the body 110' is described by being assumed to be a cylindrical portion.

The cylindrical portion 110' may include a first cylindrical portion **110*a*' and a second cylindrical portion 110*b*'**.

Each of the first cylindrical portion 110*a*' and the second cylindrical portion 110*b*' has a cylindrical shape, an upper opening and a lower opening respectively. Each of the first cylindrical portion 110*a*' and the second cylindrical portion 110*b*' has an upper portion defining the upper opening and a lower portion defining the lower opening.

The second cylindrical portion 110*b*' is disposed under the first cylindrical portion 110*a*'. The first cylindrical portion 110*a*' is disposed on the second cylindrical portion 110*b*'. The lower portion of the first cylindrical portion 110*a*' is connected to the upper portion of the second cylindrical portion 110*b*'. The lower opening of the first cylindrical portion 110*a*' has the same diameter as that of the upper opening of the second cylindrical portion 110*b*'.

A dome 130' is disposed on the upper portion of the first cylindrical portion 110*a*'. The dome 130' blocks the upper opening of the first cylindrical portion 110*a*'.

The reflective plate 200 is disposed on the first cylindrical portion 110*a*'. The reflective plate 200 may be also disposed in any one position between the first cylindrical portion 110*a*' and the second cylindrical portion 110*b*'. For example, the reflective plate 200 may be disposed in a point where the first cylindrical portion 110*a*' contacts with the second cylindrical portion 110*b*', or in at least one of the upper portion, middle portion and lower portion of the first cylindrical portion 110*a*' or the second cylindrical portion 110*b*'.

The first cylindrical portion 110*a*' and the second cylindrical portion 110*b*'may have mutually different cylindrical shapes. The first cylindrical portion 110*a*' may have a cylindrical shape of which the diameter is constant toward the lower portion thereof from the upper portion thereof. The second cylindrical portion 110*b*' may have a cylindrical shape of which the diameter decreases toward the lower portion thereof from the upper portion thereof. Therefore, the minimum diameter of the second cylindrical portion 110*b*' is less than that of the first cylindrical portion 110*a*'. Also, the minimum diameter of the first cylindrical portion 110*a*' is larger than the diameter of one circular side of the heat sink 400 on which the light source 300 is disposed. Here, the maximum diameter of one circular side of the heat sink 400 may correspond to the diameter of the circular guide 450 of the heat sink 400 shown in FIG. 3. The minimum diameter of one circular side of the heat sink 400 may correspond to the diameter of the circular placement portion 410 of the heat sink 400 shown in FIG. 3.

The lower opening and the upper opening of the first cylindrical portion 110*a*' may have the same circular shape, or a diameter difference between the lower opening and the upper opening of the first cylindrical portion 110*a*' may be within 5%. The lower opening of the second cylindrical portion 110*b*' may have a circular shape of which the diameter is less than that of the upper opening of the second cylindrical portion 110*b*'. Also, the lower opening and the upper opening of the second cylindrical portion 110*b*' may have the same circular shape, or a diameter difference between the lower opening and the upper opening of the second cylindrical portion 110*b*' may be within 5%. The lower opening of the first cylindrical portion 110*a*' may have a circular shape of which the diameter is less than that of the upper opening of the first cylindrical portion 110*a*'.

The second cylindrical portion 110*b*' may have a predetermined curvature. That is, the second cylindrical portion 110*b*' may have a cylindrical surface having a predetermined curvature.

The maximum diameter of the first cylindrical portion 110*a*' may be larger than that of the heat sink 400. When the maximum diameter of the first cylindrical portion 110*a*' is larger than that of the heat sink 400, rear light distribution characteristic of the lighting device according to the another embodiment can be improved.

The dome 130' is coupled to the first cylindrical portion 110*a*' of the cylindrical portion 110'. Specifically, the dome 130' is connected to the upper portion of the cylindrical portion 110' in such a manner as to block the upper opening of the first cylindrical portion 110*a*'.

The dome 130' has a hemispherical shape. Here, the hemispherical shape includes not only a geometrically perfect hemisphere but also a hemisphere of which the curvature is larger or smaller than that of the perfect hemisphere.

The lighting device shown in FIGS. 7 to 8 includes more light sources 300 than the lighting device shown in FIGS. 1 to 4. The power (W) of the lighting device shown in FIGS. 7 to 8 is larger than that of the lighting device shown in FIGS. 1 to 4. However, like the lighting device shown in FIGS. 1 to 4, the lighting device shown in FIGS. 7 to 8 may include two light sources 300.

Figure 10:
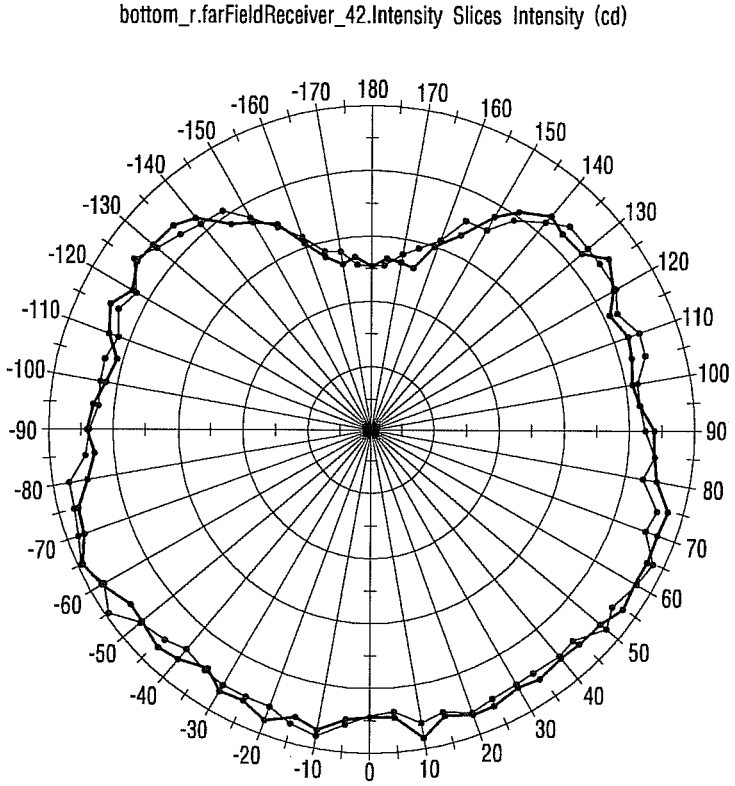
FIG. 10 is a diagram showing luminous intensity distribution of the lighting device shown in FIGS. 7 to 8.

FIG. 10 is a diagram showing luminous intensity distribution of the lighting device shown in FIGS. 7 to 8.

Referring to FIG. 10, it can be seen that luminous flux (lumen) between 130° to 180° is larger than 10% of the total luminous flux. Therefore, it can be seen that the lighting device according to the embodiment satisfies Energy Star specifications.

The lighting device shown in FIGS. 1 to 4 and the lighting device shown in FIGS. 7 to 8 have the reflective plate 200.

However, the reflective plate 200 has a high reflectance. Therefore, when the lighting device according to the embodiments is turned on, the reflective plate 200 may cause a dark portion in the dome 130 and 130' of the cover 100 and 100'.

Figure 11:
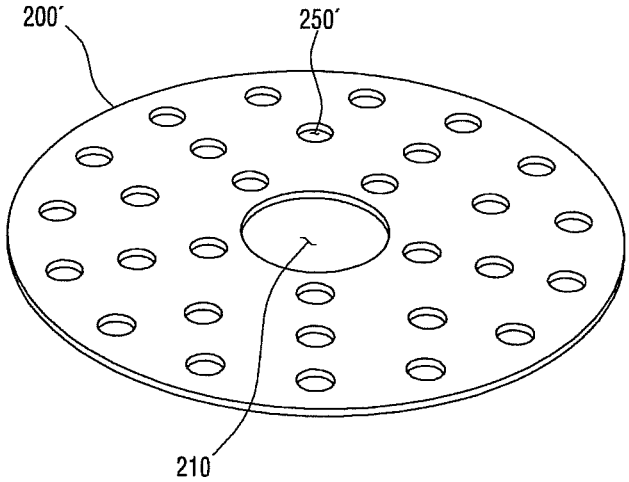
FIG. 11 is a perspective view showing a modified example of the reflective plate of the lighting device shown in FIGS. 1 to 4 and the lighting device shown in FIGS. 7 to 8.

Accordingly, for the purpose of removing the dark portion of the dome 130 and 130', the lighting device shown in FIGS. 1 to 4 and the lighting device shown in FIGS. 7 to 8 have a reflective plate 200' shown in FIG. 11.

FIG. 11 is a perspective view showing a modified example of the reflective plate of the lighting device shown in FIGS. 1 to 4 and the lighting device shown in FIGS. 7 to 8.

Referring to FIG. 11, the reflective plate 200' includes further a plurality of holes 250'. The plurality of the holes 250' may be disposed to surround the opening 210. The plurality of the holes 250' may spread out widely on the reflective plate 200'. The hole 250' may be smaller than the opening 210.

Since the reflective plate 200' is not disposed close to the dome 130 and 130', it is possible to remove the dark portion of the dome 130 and 130' to a certain extent by the hole 250'.

Figure 12:
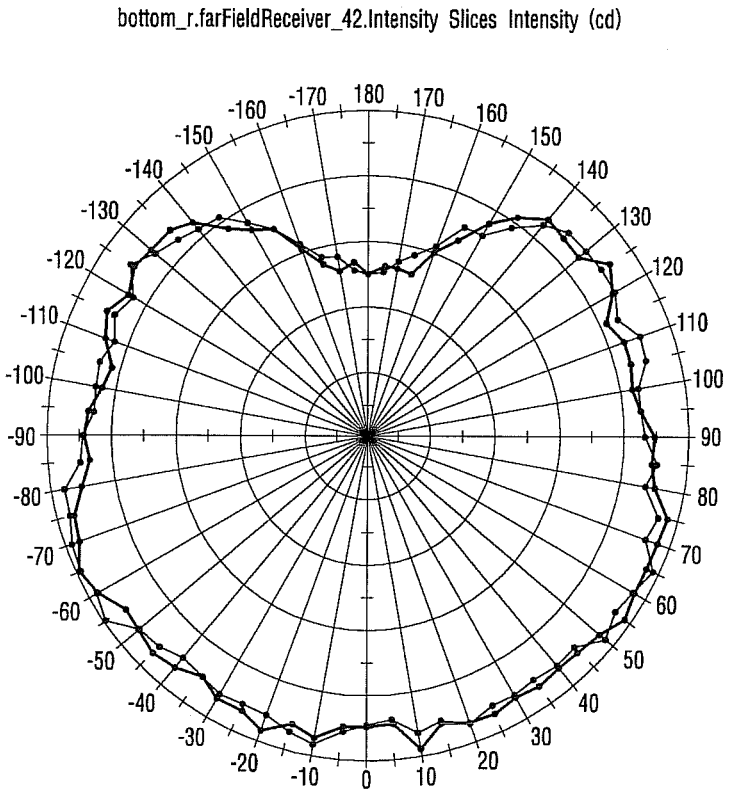
FIG. 12 is a diagram showing luminous intensity distribution of the lighting device which is shown in FIGS. 7 to 8 and includes the reflective plate shown in FIG. 11.

FIG. 12 is a diagram showing luminous intensity distribution of the lighting device which is shown in FIGS. 7 to 8 and includes the reflective plate shown in FIG. 11.

Referring to FIG. 12, it can be seen that luminous flux (lumen) between 130° to 180° is larger than 10% of the total luminous flux. Therefore, it can be seen that the lighting device according to the embodiment satisfies Energy Star specifications and is capable of removing the dark portion of the cover by using the reflective plate.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

The invention claimed is:

1. A lighting device comprising:

a heat sink comprising a lower portion and an upper portion including one surface;

a light source provided on the one surface of the heat sink, and the light source including a substrate and a light emitting device disposed on the substrate;

a cover coupled to the upper portion of the heat sink, and the cover including a dome provided on the light source and a body supporting the dome;

a reflective plate provided in the body and having an opening through which a part of light from the light source passes, the reflective plate including a plurality of holes, wherein the reflective plate is within a space defined by the body, the reflective plate having a maximum radius and a minimum radius, and the opening is within a space defined by the minimum radius of the reflective plate; and a case coupled to the lower portion of the heat sink, wherein the body of the cover includes an upper portion coupled to the dome, a lower portion coupled to the heat sink, and a middle portion disposed between the upper portion and the lower portion, wherein the reflective plate is provided on the upper portion or the middle portion of the body, wherein the opening of the reflective plate is provided at a center portion of the reflective plate, and wherein the plurality of holes are provided around the opening, and wherein a luminous flux between 130° to 180° based on a central axis of the cover is larger than 10% of a total luminous flux of the lighting device.

2. The lighting device of claim 1, wherein the body has an upper opening defined by the upper portion and a lower opening defined by the lower portion, and wherein the reflective plate is provided in the upper opening.

3. The lighting device of claim 1, wherein the body of the cover has a cylindrical shape.

4. The lighting device of claim 1, wherein the body of the cover comprises a second body which is coupled to the heat sink, and a first body which is disposed on the second body and on which the reflective plate is disposed, wherein the second body has an upper opening and a lower opening, and wherein a diameter of the lower opening of the second body is less than that of the upper opening of the second body.

5. The lighting device of claim 4, wherein the first body has an upper opening and a lower opening, and wherein a diameter difference between the upper opening of the first body and the lower opening of the first body is within 5%.

6. The lighting device of claim 4, wherein the first body has a cylindrical shape of which the diameter is constant toward a lower portion of the first body from an upper portion of the first body, and wherein the second body has a cylindrical shape of which the diameter decreases toward a lower portion of the second body from an upper portion of the second body.

7. The lighting device of claim 1, wherein the hole is smaller than the opening.

8. The lighting device of claim 1, wherein the heat sink comprises:

a placement portion on which the light source is disposed;

a guide that is coupled to the body of the cover; and a recess that is provided between the placement portion and the guide and on which the body of the cover is disposed.

9. The lighting device of claim 8, wherein the substrate is disposed on the placement portion of the heat sink, and wherein the placement portion of the heat sink comprises a guider that guides the substrate.

10. A lighting device comprising:

a heat sink, comprising a lower portion, an upper portion including a base, and a placement portion disposed on the base;

a light source including a substrate disposed on the placement portion of the heat sink and a light emitting device disposed on the substrate;

a cover provided on the light source and coupled to the upper portion of the heat sink; and a reflective plate provided within the cover to reflect light from the light source and having an opening to allow transmission of the light from the light source, wherein the cover comprises a hemispherical upper portion, and a lower portion provided under the upper portion of the cover to surround the light source, the reflective plate being provided within the lower portion of the cover, wherein the reflective plate is within a space defined by the lower portion of the cover, the reflective plate having a maximum radius and a minimum radius, and the opening is within a space defined by the minimum radius of the reflective plate, wherein a luminous flux between 130° to 180° based on a central axis of the cover is larger than 10% of a total luminous flux of the lighting device, and wherein a distance from a highest portion of the hemispherical upper portion of the cover to a top surface of the reflective plate is less than a distance from a lowest portion of the reflective plate to the light emitting device.

11. The lighting device of claim 10, wherein the lower portion comprises:

a first lower portion coupled to the upper portion; and a second lower portion provided under the first lower portion and coupled to the heat sink, a minimum diameter of the second lower portion being less than that of the first lower portion.

12. The lighting device of claim 11, wherein the base of the heat sink has a circular shape, and a diameter of the circular side is less than the minimum diameter of the first lower portion.

13. The lighting device of claim 11, wherein the first lower portion has a cylindrical shape of which the diameter is constant toward a lower portion of the first lower portion from an upper portion of first lower portion, and the second lower portion has a cylindrical shape of which the diameter decreases toward a lower portion of the second lower portion from an upper portion of the second lower portion.

14. The lighting device of claim 10, wherein the heat sink comprises:

a placement holder on which the light source is disposed;

a guide coupled to the lower portion of the cover; and a recess provided between the placement holder and the guide and on which the lower portion of the cover is disposed.

15. A lighting device comprising:

a heat sink comprising a lower portion and an upper portion including one surface;

a light source provided on the one surface of the heat sink, and the light source including a substrate and a light emitting device disposed on the substrate;

a cover comprising a dome provided on the light source, and a body including a second body that is coupled to the upper portion of the heat sink and a first body that is disposed on the second body;

a reflective plate provided in the first body of the cover and having an opening through which a part of light from the light source passes, the reflective plate including a plurality of holes, wherein the reflective plate is within a space defined by the body, the reflective plate having a maximum radius and a minimum radius, and the opening is within a space defined by the minimum radius of the reflective plate; and a case coupled to the lower portion of the heat sink, wherein the first body of the cover includes an upper portion coupled to the dome, a lower portion coupled to the second body, and a middle portion disposed between the upper portion of the first body and the lower portion of the first body, wherein the reflective plate is provided on the upper portion or the middle portion of the first body, wherein the opening of the reflective plate is provided at a center portion of the reflective plate, and the plurality of holes at the reflective plate are provided around the opening of the reflective plate, wherein a distance from a highest portion of the dome to a top surface of the reflective plate is less than a distance from a bottom surface of the reflective plate to the light emitting device based on a central axis of the cover, and wherein a lowest portion of the reflective plate is spaced apart from the substrate of the light source.

16. The lighting device of claim 15, wherein reflectance of the reflective plate is from 90% to 99%.

17. The lighting device of claim 15, wherein the first body has a cylindrical shape of which the diameter is constant toward a lower portion of the first body from an upper portion of the first body, and wherein the second body has a cylindrical shape of which the diameter decreases toward a lower portion of the second body from an upper portion of the second body.

18. The lighting device of claim 15, wherein a diameter difference between the upper opening of the second body and the lower opening of the second body is within 5%.

* * * * *